United States Patent [19]

Stein

[11] 4,311,223

[45] Jan. 19, 1982

[54] BOWLING BAG

[75] Inventor: Edward B. Stein, Chicago, Ill.

[73] Assignee: Stebco Industries, Inc., Chicago, Ill.

[21] Appl. No.: 131,842

[22] Filed: Mar. 19, 1980

[51] Int. Cl.[3] ..... A63B 47/00

[52] U.S. Cl. ..... 190/51; 150/52 A

[58] Field of Search ..... 150/52 A; 206/315 B; 190/51, 48; D3/36; 224/45 L

[56] References Cited

U.S. PATENT DOCUMENTS

| | | | |
|---|---|---|---|
| 2,991,859 | 7/1961 | Kaplan | 150/52 A X |
| 3,136,398 | 6/1964 | Platt | 150/52 A X |
| 3,220,520 | 11/1965 | Glantz | 190/51 X |
| 3,497,676 | 2/1970 | Gravatt | 150/52 A X |

FOREIGN PATENT DOCUMENTS

| | | | |
|---|---|---|---|
| 1381537 | 11/1964 | France | 150/52 A |

*Primary Examiner*—Donald F. Norton

*Attorney, Agent, or Firm*—Hill, Van Santen, Steadman, Chiara & Simpson

[57] ABSTRACT

A hand-carried bowling bag for one or two bowling balls, as desired. The bag includes a pair of hard shell similarly shaped bag sections which are hinged and latched together along opposite edges. Each section is of a generally cup-shaped configuration having open sides mounted in confronting relation defining a cavity for receiving a bowling ball or balls. Ball mounting means for securely positioning one or two bowling balls is disposed for coacting with the bowling ball inside the cavity defined by the sections. The ball mounting means comprises three sets of longitudinally contiguous sockets supported by opposed walls of the sections. The sets of contiguous sockets on the bag sections are positioned vertically above the lower edges a sufficient distance for enabling opposite sides of a bowling ball to be positioned within anyone of the three sets of longitudinally spaced sockets to inhibit movement of the ball when so engaged while the bag sections are in a closed position relative to one another.

19 Claims, 8 Drawing Figures

FIG. 4
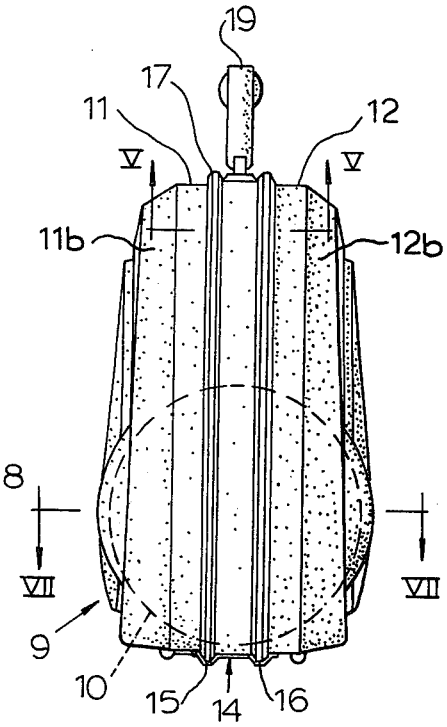
FIG. 5
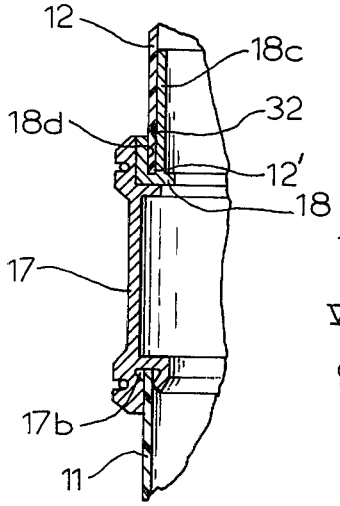
FIG. 6
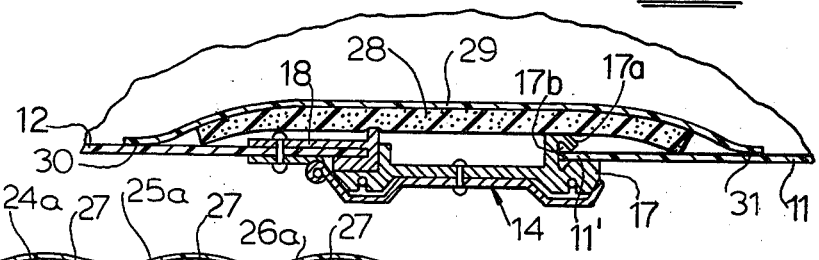
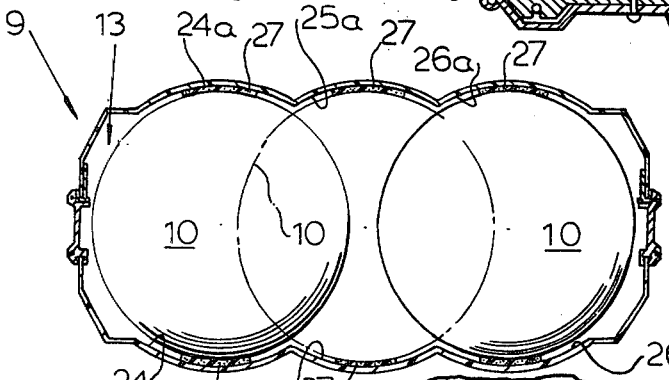
FIG. 7
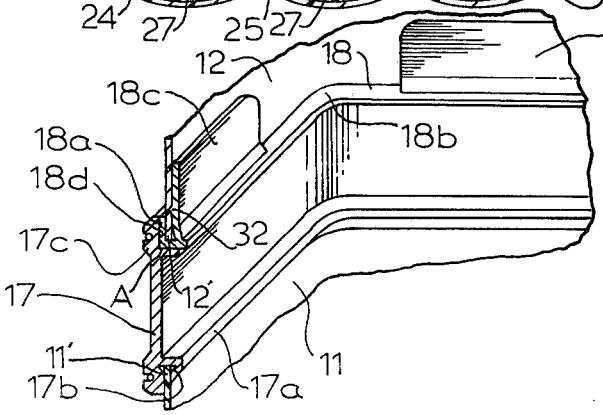
FIG. 8

BOWLING BAG

BACKGROUND OF THE INVENTION

1. Field of the Invention

With respect to bowling bags, a number of different types have existed in the past. More particularly, soft-sided vinyl and fabric bags have existed for carrying one or two bowling balls depending upon the size of the bag. These soft-sided bags generally are the type that have a zipper which functions to provide a closure for separable bag sections. Various types of handles have been provided for supporting the bags. Also, various types of supports have been provided interiorly of the bags for supporting a bowling ball at its bottom surface inside of the bag.

Other types of bags that have existed in the past include a so-called "hard" bag for carrying only a single bowling ball which has a pair of molded sections of an unbreakable ABS formulation of material in hinged assembly. The "hard" bag has been provided with extruded aluminum frames which are located at the open side of the matched back sections. Latches are provided at the top and handles are positioned over the latches and secured to one or more of the bag sections for transporting the bag. With the "hard" bags, a molded ball cup and shoe-shelf have been provided as added features.

2. The Prior Art

Another molded prior art bag that has previously existed is known in the field as a "Duck Pin" type bag for carrying a pair of "Duck Pin" balls in side-by-side relation. With this bag a pair of sockets are formed in the opposite sidewalls of the hinged sections enabling a pair of "Duck Pin" balls to be carried in side-by-side relation interiorly of the bag. There has been no provision in this bag for a third socket for carrying a single ball in centered balanced relation interiorly of the bag and with the third socket being positioned between the other two sockets.

BRIEF DESCRIPTION OF THE INVENTION

The present invention relates to a new and improved so-called "hard" bag formed from a molded unbreakable ABS formulation or any suitable material and which is particularly constructed to be capable of either carrying a single bowling ball or a pair of bowling balls, as desired. This new bowling bag has a pair of hard shell similarly shaped sections which are each of a generally cup-shaped configuration. These sections have open sides that are disposed in confronting relation and together define a cavity for receiving one or more bowling balls. Hinge means are provided at a bottom of the bag for joining the bag sections in assembly together. Handle means are also provided for joining the sections along the upper edges thereof. Latch means is also provided for joining the bag sections.

According to important features of the present invention, new and improved ball mounting means are provided for the bowling bag for securely positioning one or two bowling balls inside the cavity defined by the sections. According to other features of the invention the ball mounting means comprises three sets of longitudinally contiguous sockets supported by opposed walls of the sections. These contiguous sockets are disposed in side-by-side relation vertically above the lower edges a sufficient distance for enabling opposite sides of a bowling ball to be positioned within any one of the three sets of longitudinally contiguous sockets to inhibit movement of the ball when so engaged while the bag sections are in a closed position relative to one another. According to further features of this invention, the ball receiving sockets are so located to enable the ball to be engaged upon lower edges or margins of the bag sections when mounted inside the cavity and defined by the closed ball section.

Yet other features of the present invention concern the placement of the handle means in a centered position with respect to the three sets of longitudinally contiguous sockets so that the load of a single bowling ball when carried in a centermost of the sockets can be uniformly balanced relative to the handle means to facilitate ready transport of the ball and of the bag. Yet still a further feature of the invention concerns the placement of the handle means with respect to opposite endmost of the longitudinally contiguous sockets enabling a pair of bowling balls to be carried in the opposite endmost sockets in side-by-side relation so that the load of the bowling balls can be uniformly balanced with respect to the sections when the bag is transported by the handle means.

Still other features of this invention will become apparent in view of the following detailed description taken in conjunction with the accompanying drawings.

BRIEF DESCRIPTION OF THE DRAWINGS

FIG. 4 is an end elevation of the bowling bag shown in FIGS. 1–3 and with the bowling ball being shown by dotted lines;

FIG. 5 is an enlarged fragmentary cross sectional view taken on the line V—V looking in the direction indicated by the arrows as seen in FIG. 4;

FIG. 6 is an enlarged fragmentary vertical section taken on the line VI—VI looking in the direction indicated by the arrows as seen in FIG. 3;

FIG. 7 is an enlarged cross section taken on the line VII—VII looking in the direction of the arrows as seen in FIG. 4; and FIG. 8 is an enlarged fragmentary perspective view showing a corner section of the bowling bag.

DESCRIPTION OF THE PREFERRED EMBODIMENTS

Figure 1:
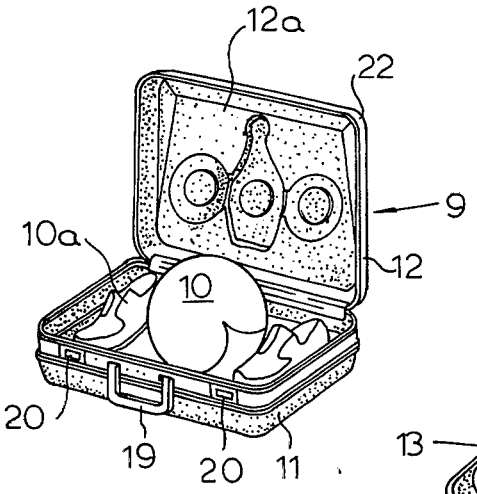
FIG. 1 is a perspective view of a bowling bag with a bowling ball disposed therein, the bag being shown in an open position and with this bag embodying important features of my invention.
Figure 2:
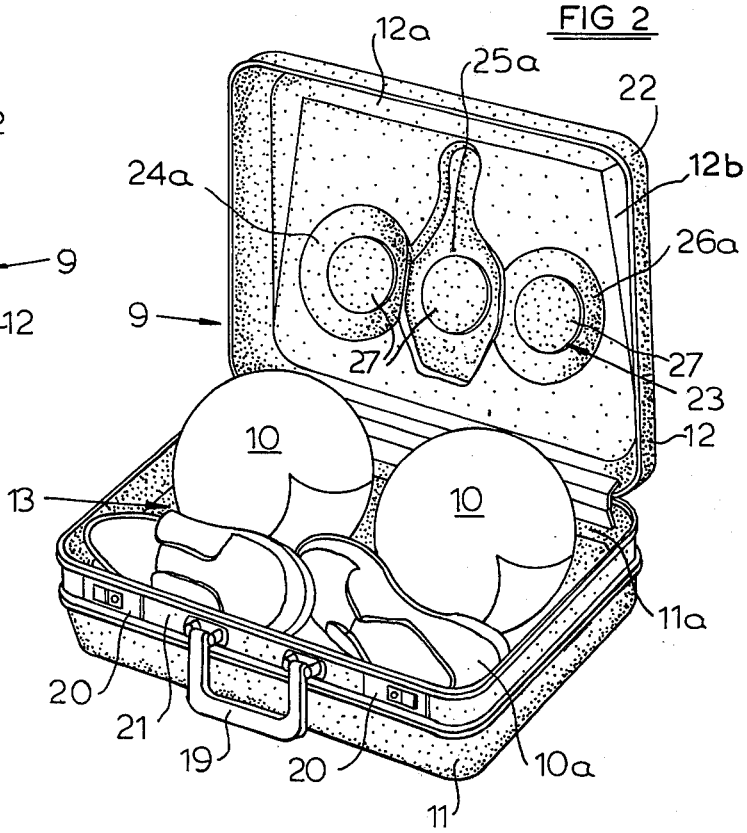
FIG. 2 is an enlarged perspective view of a bowling bag similar to FIG. 1 only illustrating a pair of balls and a pair of bowling shoes in the bag.

The reference numeral 9 indicates generally my bowling bag embodying the features of my invention, as herein disclosed. The bag 9 is adapted for transporting one or two bowling balls 10 as shown in FIGS. 1 and 2, along with bowling shoes as indicated at 10*a*.

Figure 3:
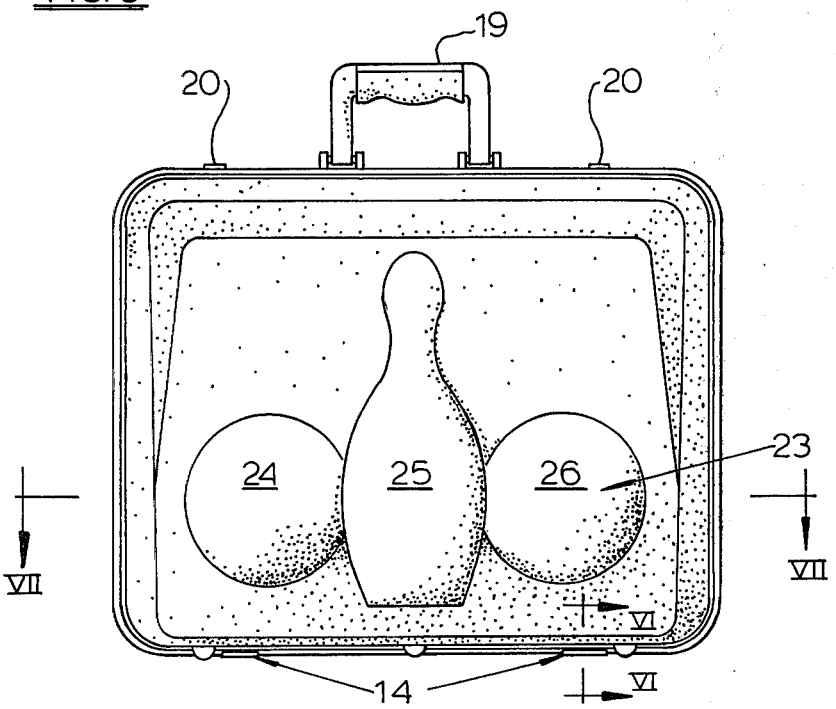
FIG. 3 is an enlarged side elevation of the bowling bag shown in FIGS. 1 and 2.

The bag 9 is comprised of a pair of hard shell similarly shaped bag sections 11 and 12. Each of the bag sections 11 and 12 is of a generally cup-shaped configuration and has open sides 11*a* and 12*a* mounted in confronting relation defining a cavity 13 for receiving the bowling ball and the shoes. Suitable hinges 14 comprising hinge means are joined with the bag sections 11 and 12 for hinging the sections in assembly together as is seen in FIG. 3. The hinging of the bag is accomplished in a more or less conventional manner. More particularly, these hinges 14 serve to join lower edges 15 and 16 of aluminum frames 17 and 18 of the sections 11 and 12 in assembly together. Handle 19 is suitably attached to one of the sections 11 and 12 and is cooperable with the sections for transporting the same as will be further discussed hereafter. Suitable latches 20 are also provided for joining the bag sections 11 and 12 in assembly along upper margins 21 and 22 of the aluminum frames 17 and 18 on the bag sections 11 and 12 in a conventional manner.

According to important features of my invention, I have provided ball mounting means 23 for securely positioning one or two bowling balls 10 inside the cavity 13 defined by the sections 11 and 12. The ball mounting means 23 comprises three sets of longitudinally contiguous sockets 24, 24*a*, 25, 25*a*, and 26, 26*a* on the bag. These sockets are positioned vertically above lower edges and the hinges 14 a sufficient distance for enabling opposite sides of the bowling ball 10 to be positioned within anyone of the three sets of longitudinally contiguous sockets to inhibit movement of the ball when so engaged while the bag sections 11 and 12 are in a closed position relative to one another (see FIGS. 2 and 4).

The endmost sockets 24, 24*a* and 26, 26*a* are each of a circular concave shape while the centermost socket 25, 25*a* provides a socket that is in the shape of a duck pin although it will be noted that when a bowling ball 10 is engaged in the centermost set of sockets 25, 25*a* that only a portion of the duck-shaped sockets is utilized for the purposes of securing and holding the ball 11 in a fixed position in the bag when its bag sections are in a closed position.

In order that the bowling ball 10 can be snugly mounted within any one of the sockets 24, 24*a*, 25, 25*a* and 26, 26*a*, cushioning pads 27 are mounted in each of the bottoms of aforesaid socket portions. In addition a cushioning pad (FIG. 6) is provided at the bottom of the bag 9 which cushioning pads spans the hinge 14 and laps the aluminum frame 17 and 18 so that the ball can be properly supported and scratching of the ball can be prevented. A synthetic plastic cover strip 29 extends over the pad 28 and is secured by suitable glue or a fastener at 30 and 31 to adhere the opposite edges of the retaining piece to the bag sections 11 and 12.

The aluminum frames 17 and 18 each are preferably comprised of aluminum extrusions. To this end, the aluminum frame 17 has a generally C-shaped end portion 17*a* that extends angularly and provides a frame socket 17*b* for receiving an outermost end 11' of a bag section 11 as seen in FIG. 8. The socket is snugly engaged with the end 11' of the bag section in retained assembly therewith.

The other aluminum frame 18 is generally L-shaped or angle-shaped providing a pair of legs 18*a* and 18*b*. In addition, the aluminum frame 18 has a series of leg sections 18*c* which coacts with the legs 18*a* and 18*b* to define frame sockets 18*d*. The other bag section 12 has an outermost end 12' that is retainingly engaged in the socket 18*d* in permanent assembly therewith. Thus, when the bag is to be opened, the bag sections 11 and 12 pivot on hinges 14 and the frame 17 and 18 separate at the point where the frames are shown in engaged assembled relation, generally as indicated at A (FIG. 8). Unto this end, aluminum frame 17 has an angled opposite end 17*c* that is formed so as to be capable of matched engagement with legs 18*a* and 18*b* of aluminum frame 18 (FIG. 8). As shown in FIG. 5, the upright leg 18*c* is provided with a pointed projection 32 that can be pressed into the material of the bag section 12 to snugly secure the outer end of the bag section 12' in the frame socket 18*d*.

The bag sections 11 and 12 can be made from any suitable material such as a molded unbreakable ABS formulation synthetic plastic. It will further be noted that in order to allow the bag to be made as compact as possible that the outside sockets or endmost sockets 24, 24*a* and 26, 26*a* lap the centermost socket 25, 25*a* shown in FIG. 7. Similarly the outer margin of the socket 25, 25*a* also laps the endmost sockets so that in actuality portions of the endmost sockets form a part of the centermost socket 25, 25*a*, and in addition, the centermost socket 25, 25*a* also serves to form or provide portions of the endmost sockets 24, 24*a* and 26, 26*a*. The lapping relationships of the sockets is best seen in FIG. 7 where the various ball positions of the bowling ball 10 are illustrated and here it will be observed how the ball 10 extends into the different sockets depending on its position.

In view of the foregoing description it will be now seen that another important advantage of the present invention resides in the fact that with a bowling bag construction of the type herein disclosed, it is not necessary to utilize a metal rack for supporting the ball or balls within the bag. In the prior types of vinyl bowling bags commonly being marketed, metal racks have been utilized for two purposes. These racks support the ball within the bag and also provide a space beneath the ball for the bowling shoes to be sorted. By eliminating the need for a metal rack within the bag, the cost of the bag can be minimized.

It will further be appreciated that a standarized bowling ball has a diameter of roughly 8¼ inches. It therefore will be appreciated that the circular sockets are provided in the bag sections must have a spherical diameter slightly in excess of the diameter of the bowling ball to be carried therein. By making the pads for cushioning the positioning of the ball within the bag of a suitable synthetic plastic having a memory characteristic which enables the cushioning pad material to spring back after being depressed, a snug fit between the socket and the bowling ball can be insured.

In order to provide the bag 9 with added width to accommodate the full sized bowling balls 10, the bag sections 11 and 12 are provided with expander wall portions 11*b* and 12*b*. By using expander wall portions 11*b* and 12*b*, the bag sections 11 and 12 can be manufactured more compactly and the depth of the sockets 24, 25 and 26 and the extent of their protrusion from the bag sections 11 and 12 can be minimized.

I claim as my invention:

1. A bowling bag for one or two bowling balls, as desired, including a pair of hard shell similarly shaped bag sections each of a generally cup-shaped configuration having open sides mounted in confronting relation defining a cavity for receiving a bowling ball or balls, hinge means joining said bag sections in assembly together along respective lower edges of said sections, handle means cooperable with said sections for transporting the same, latch means joining said bag sections along upper margins of said bag sections, ball mounting means for securely positioning one or two bowling balls inside said cavity defined by said sections, said ball mounting means comprising three sets of longitudinally contiguous sockets supported by opposed walls of said sections, the sets of contiguous sockets on said bag sections positioned vertically above said lower edges a sufficient distance for enabling opposite sides of a bowling ball to be positioned within anyone of said three sets of longitudinally spaced sockets to inhibit movement of the ball when so engaged while the bag sections are in a closed position relative to one another, and with the sockets so located to enable the ball to be engaged upon the lower edges of the bag sections when mounted inside of the cavity defined by the closed bag sections, the handle means being positioned in a centered position with respect to said sockets so that the load of the bowling ball when carried in a centermost of said sockets can be uniformly balanced relative to the handle means to facilitate ready transport of the ball, the handle means being so positioned with respect to opposite endmost of the longitudinally contiguous sockets enabling bowling balls to be carried and supported in side-by-side relation within the endmost sockets so that the load of the bowling balls can be uniformly balanced with respect to the sections when the bag is transported by said handle means.

2. The bowling bag of claim 1 further characterized by each of said sets of sockets comprising rounded protrusions in the side walls of said pair of hard shell similarly shaped bag sections.

3. The bowling bag of claim 2 further characterized by each of said sockets having a cushioning pad mounted in its bottom inside of said cavity for cushioned engagement with side surfaces of the bowling balls.

4. The bowling bag of claim 2 further characterized by the side walls of the hard shell bag sections being so spaced as to enable opposed side surfaces of a bowling ball to be snugly engaged in the associated pair of said sockets thus locking the ball in a relatively fixed position within the cavity defined by the bag sections.

5. The bowling bag of claim 1 further characterized by each of said sockets having a cushioning pad mounted in its bottom inside of said cavity for cushioned engagement with side surfaces of the bowling ball.

6. The bowling bag of claim 5 further characterized by cushioning means carried by said sections inside said cavity over said lower edges for cushioned engagement with a bottom surface of a bowling bag.

7. The bowling bag of claim 1 further characterized by cushioning means carried by said sections inside said cavity over said lower edges for cushioned engagement with a bottom surface of a bowling ball.

8. The bowling bag of claim 1 further characterized by the hard shell similarly shaped bag sections being relatively inflexible thus resisting movement of a bowling ball from the associated pair of sockets upon impact.

9. The bowling bag of claim 1 further characterized by frame means encircling annular edges defining open ends of said hard shell similarly shaped cup-shaped bag sections, and means securing said frame means in fixed assembly with said bag sections.

10. The bag of claim 1 further characterized by the sections each having an expander wall portion enabling the depth of the sockets to be minimized.

11. The bag of claim 1 further characterized by the sockets being disposed in side-by-side relation and with adjacent sockets having curved wall portions which intersect one another so as to permit the three spherical cavities to receive a maximum of only two bowling balls therein.

12. A bowling bag for one or two bowling balls, as desired, including a pair of hingedly connected hard shell bag sections each comprised of a relatively inflexible material for resisting movement of a bowling ball within the bag, the sections having three side-by-side spherically shaped ball receiving cavities, said cavities being defined at least in part by three sets of longitudinally contiguous convexly shaped sockets provided in opposed walls of the sections, the sockets being disposed in side-by-side relation and having curved wall portions which intersect one another so as to be capable of receiving a maximum of only two bowling balls within the three spherical cavities.

13. The bowling bag of claim 12 further characterized by each of said sets of sockets comprising rounded protrusions in the side walls of said pair of hard shell bag sections, the bag sections being sized to allow a pair of bowling balls to be carried therein with a sufficient space to permit bowling shoes to be carried on top of the balls inside the bag.

14. The bowling bag of claim 14 further characterized by each of said sockets having a cushioning pad mounted in its bottom inside of said cavity for cushioned engagement with side surfaces of the bowling ball.

15. The bowling bag of claim 13 further characterized by the side walls of the hard shell bag sections being so spaced as to enable opposed side surfaces of a bowling ball to be snugly engaged in the associated pair of said sockets thus locking the ball in a relatively fixed position within the cavity defined by the bag sections.

16. The bowling bag of claim 12 further characterized by each of said sockets having a cushioning pad mounted in its bottom inside of said cavity for cushioned engagement with side surfaces of the bowling ball.

17. The bowling bag of claim 16 further characterized by cushioning means carried by said sections inside said cavity over said lower edges for cushioned engagement with a bottom surface of a bowling bag.

18. The bowling bag of claim 12 further characterized by the hard shell similarly shaped bag sections being relatively inflexible thus resisting movement of a bowling ball from the associated pair of sockets upon impact.

19. The bowling bag of claim 12 further characterized by frame means encircling annular edges defining open ends of said hard shell bag sections, and means securing said frame means in fixed assembly with said bag sections.

* * * * *